US008549939B2

(12) United States Patent
Ogawa et al.

(10) Patent No.: US 8,549,939 B2
(45) Date of Patent: Oct. 8, 2013

(54) START CONTROL DEVICE

(75) Inventors: Yasufumi Ogawa, Chiyoda-ku (JP); Takeru Okabe, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 495 days.

(21) Appl. No.: 12/958,000

(22) Filed: Dec. 1, 2010

(65) Prior Publication Data

US 2011/0239821 A1 Oct. 6, 2011

(30) Foreign Application Priority Data

Apr. 6, 2010 (JP) ..... 2010-087742

(51) Int. Cl.

| | |
|---|---|
| ***F02N 15/00*** | (2006.01) |
| ***F02N 15/02*** | (2006.01) |
| ***F02N 15/06*** | (2006.01) |
| ***F02N 11/08*** | (2006.01) |

(52) U.S. Cl.
USPC ..... 74/7 R; 123/179.3

(58) Field of Classification Search
USPC ..... 74/6, 7 R, 7 C, 7 E; 123/179.1–184.1
See application file for complete search history.

(56) References Cited

U.S. PATENT DOCUMENTS

| | | | | |
|---|---|---|---|---|
| 4,464,576 | A * | 8/1984 | Williams | 290/38 R |
| 5,402,758 | A * | 4/1995 | Land et al. | 123/179.3 |
| 6,634,332 | B2 | 10/2003 | Saito et al. | |
| 7,105,944 | B2 * | 9/2006 | Wakitani et al. | 307/10.6 |
| 7,145,259 | B2 * | 12/2006 | Spellman et al. | 290/38 R |
| 7,218,010 | B2 * | 5/2007 | Albertson et al. | 290/38 R |
| 7,996,135 | B2 * | 8/2011 | Ishii et al. | 701/54 |
| 8,069,832 | B2 * | 12/2011 | Okumoto et al. | 123/179.4 |
| 8,079,340 | B2 * | 12/2011 | Okumoto et al. | 123/179.4 |
| 8,162,801 | B2 * | 4/2012 | Liu et al. | 477/185 |
| 8,171,908 | B2 * | 5/2012 | Senda et al. | 123/179.4 |
| 8,370,051 | B2 * | 2/2013 | Pursifull et al. | 701/112 |
| 8,413,635 | B2 * | 4/2013 | Machida et al. | 123/339.14 |
| 2009/0183557 | A1 | 7/2009 | Ono | |
| 2010/0064786 | A1 * | 3/2010 | Ge et al. | 73/114.25 |
| 2010/0251853 | A1 * | 10/2010 | Usami et al. | 74/7 C |

FOREIGN PATENT DOCUMENTS

| | | | |
|---|---|---|---|
| DE | 199 14 904 | A1 | 10/2000 |
| DE | 10 2009 004 901 | A1 | 8/2009 |
| JP | 2002-122059 | A | 4/2002 |
| JP | 4214401 | B2 | 12/2005 |
| JP | 2009-162196 | A | 7/2009 |

* cited by examiner

*Primary Examiner* — Troy Chambers
*Assistant Examiner* — Michael Gonzalez
(74) *Attorney, Agent, or Firm* — Sughrue Mion, PLLC

(57) ABSTRACT

Provided is a start control device capable of reducing power consumption during the driving operation of a starter motor, to thereby improve fuel efficiency of a vehicle. In the start control device, a motor drive torque estimating part (123) estimates a motor drive torque based on a battery voltage drop amount of a battery (107) that supplies an electric power to a motor (105). A start control part (122) turns off energization of a pinion pushing device (104) by a pinion driving part (120) when the motor drive torque estimated by the motor drive torque estimating part (123) is equal to or larger than a given value.

6 Claims, 10 Drawing Sheets

START CONTROL DEVICE

BACKGROUND OF THE INVENTION

1. Field of the Invention

The present invention relates to a start control device for controlling start of, for example, an engine of a vehicle.

2. Description of the Related Art

Up to now, for the purpose of improving fuel efficiency of an automobile and reducing environmental loads, an automatic engine stop and restart system has been developed. In the automatic engine stop and restart system, when a given condition for stopping the engine is satisfied by an operation of a driver, for example, when an ON-operation of a brake is conducted at or below a given vehicle velocity, fuel supply is automatically cut, and the engine is automatically stopped. Meanwhile, when a given condition for restarting the engine is satisfied by the operation of the driver, for example, when a brake release operation is conducted or when an accelerator press-down operation is conducted, fuel injection is restarted, and the engine is automatically restarted.

In the automatic engine stop and restart system as described above, as disclosed in Japanese Patent No. 4214401, a starter capable of controlling the pushing operation of a pinion and the driving of a motor (rotation of the pinion) independently from each other, has been developed so that the engine may be restarted even during the engine rotation down period immediately after an automatic stop of the engine. In such a starter, in order to change a travel speed of the pinion to reduce a start time, a duty control is conducted, to thereby adjust a current flowing in a pinion driving coil, so that the pushing force of the pinion may be controlled.

Further, as disclosed in Japanese Patent Application Laid-open No. 2002-122059, a pull-in coil and a hold coil are disposed in a plunger that conducts the pushing operation of the pinion, and when the motor starts to be driven, the energization of the pull-in coil is blocked, and only the hold coil is energized, to thereby enable a reduction in power consumption.

In the device disclosed in Japanese Patent No. 4214401, the pinion is pushed even during the driving of the starter motor (clunking), and hence electric power is wasted for the pushing operation of the pinion, which results in the deterioration of the fuel efficiency of the vehicle.

Further, in the pinion pushing control implemented in Japanese Patent No. 4214401, the pushing operation of the pinion is implemented with a maximum duty even after the pinion engagement, and hence electric power is wasted for the pushing operation of the pinion, which results in the deterioration of the fuel efficiency of the vehicle.

Further, in the device disclosed in Japanese Patent Application Laid-open No. 2002-122059, a constant current is always supplied to the hold coil during the driving of the starter motor, and hence the amount of reduction in power consumption is small, with the result that an effect of improving the fuel efficiency of the vehicle is small.

SUMMARY OF THE INVENTION

The present invention has been made to solve the above problems, and it is an object of the present invention to provide a start control device capable of reducing power consumption during the driving of the stator motor and improving the fuel efficiency of the vehicle.

A start control device according to the present invention includes: a pinion driving means for driving a pinion pushing device that pushes a pinion into a ring gear coupled with an engine; a motor driving means for driving a motor drive device that rotationally drives a motor coupled with the pinion; a start control means for controlling an operation of the pinion driving means and the motor driving part to start the engine, in response to a start request externally received; and a motor drive torque estimating means for estimating a motor drive torque of the motor, in which the start control part controls the operation of the pinion driving part, based on the motor drive torque estimated by the motor drive torque estimating part.

According to the start control device of the present invention, the start control means controls the operation of the pinion driving means based on the motor drive torque estimated by the motor drive torque estimating means, to thereby avoid unnecessary energization of the pinion pushing device. As a result, power consumption during the driving of the starter motor may be reduced so as to improve the fuel efficiency of the vehicle.

DETAILED DESCRIPTION OF THE PREFERRED EMBODIMENTS

Hereinafter, embodiments of the present invention are described with reference to the accompanying drawings.

First Embodiment

Figure 1:
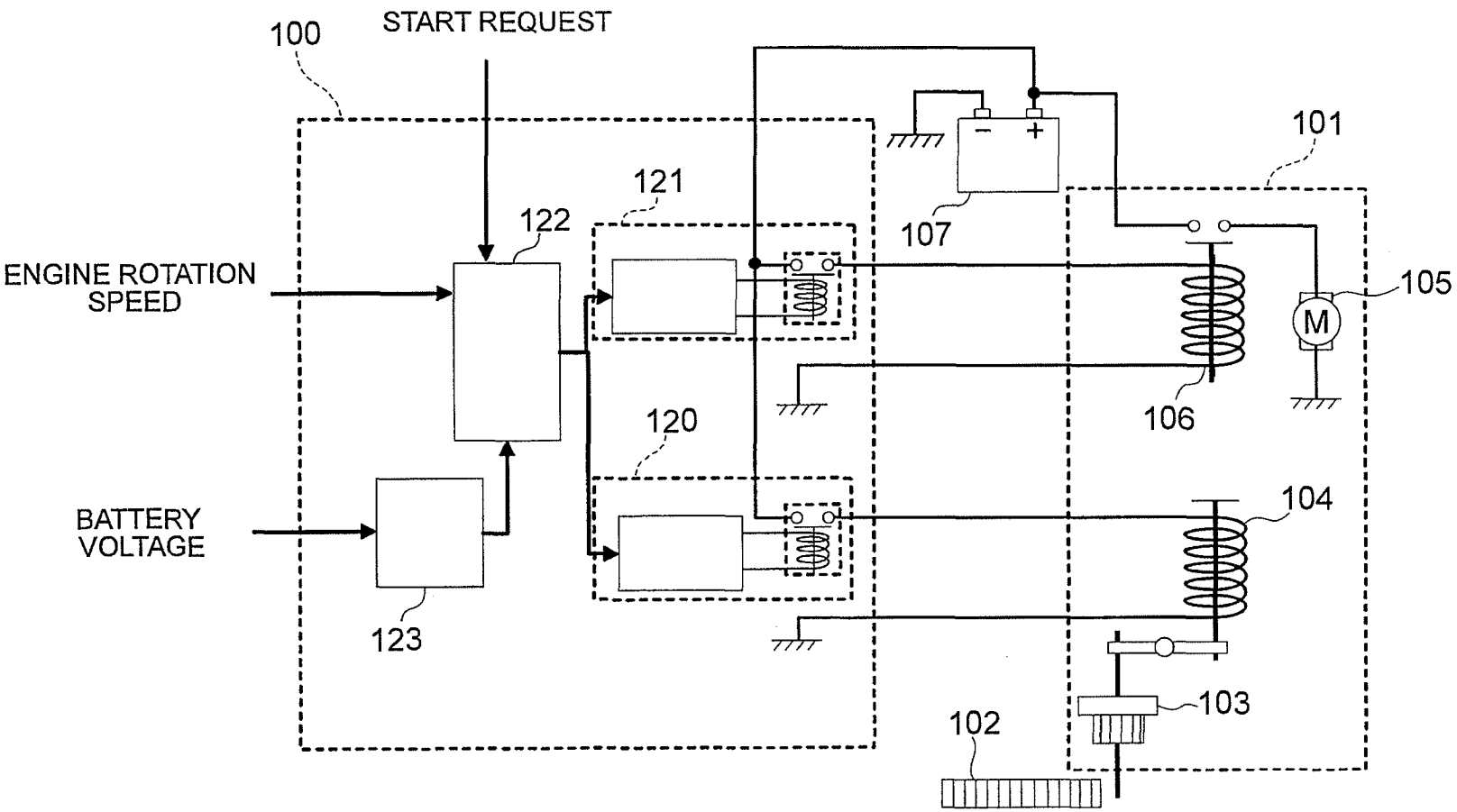
FIG. 1 is a block diagram illustrating a start control device according to a first embodiment of the present invention.

FIG. 1 is a block diagram illustrating a schematic configuration of a start control device according to a first embodiment of the present invention. In the figure, reference numeral 100 denotes a start control device. Upon receiving a start request from, for example, an engine control device (not shown), the start control device 100 starts an engine (not shown). Reference numeral 101 denotes a starter for starting the engine. Reference numeral 102 denotes a ring gear coupled with the engine (not shown). Reference numeral 103 denotes a pinion disposed in the starter 101. Reference numeral 104 denotes a pinion pushing device. The pinion pushing device 104 has a coil which is energized when the engine is started. The pinion 103 is moved so as to be engaged with the ring gear 102 when the coil of the pinion pushing device 104 is energized.

Reference numeral 105 denotes a motor coupled with the pinion 103. When the motor 105 is rotationally driven, the pinion 103 is rotated to start the engine. Reference numeral 106 denotes a motor drive device. The motor drive device 106 is a relay device that forms an electric path for allowing a current to flow in the motor 105 when the coil of the motor drive device 106 is energized. Reference numeral 107 denotes a battery. The battery 107 supplies electric power to the starter 101 and the start control device 100.

Reference numeral 120 denotes pinion driving means for driving the pinion pushing device 104. The pinion driving means 120 according to this embodiment has a relay, and when the relay turns on, the pinion pushing device 104 is energized. In other words, the pinion driving means 120 is designed to turn on and off the energization of the pinion pushing device 104. Reference numeral 121 denotes motor driving means for driving the motor drive device 106. The motor driving means 121 has a relay, similarly to the pinion driving means 120, and this relay is turned on to energize the motor drive device 106.

Reference numeral 122 denotes start control means. When a start request is received from the engine control device (not shown), the start control means 122 gives a drive instruction to the pinion driving means 120 and the motor driving means 121 so as to control the operation of the pinion driving means 120 and the motor driving means 121, to thereby start the engine. The start control means 122 implements the start control, for instance, based on an engine rotation speed calculated in the engine control device. Further, the start control means 122 is capable of controlling the driving of the pinion driving means 120 and the motor driving means 121 independently from each other. Reference numeral 123 denotes motor drive torque estimating means. The motor drive torque estimating means 123 estimates a drive torque of the motor according to, for example, a battery voltage.

Figure 2:
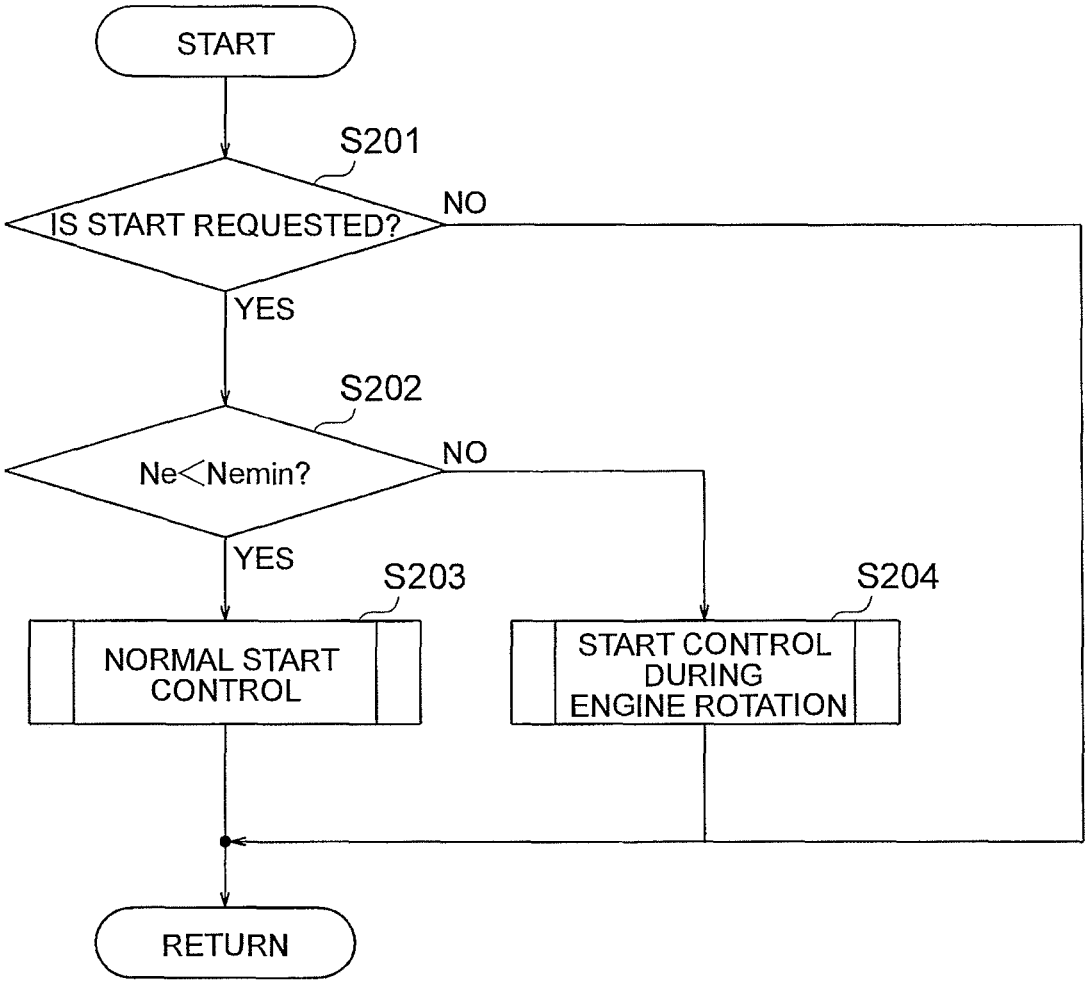
FIG. 2 is a flowchart illustrating details of processing of the start control device of FIG. 1.

FIG. 2 is a flowchart illustrating details of the processing of the start control device 100 in FIG. 1. Referring to FIG. 2, details of the start control are described. In Step S201, the start control means 122 confirms whether or not there is a start request from the engine control device (outside). The start request is generated, for example, when a driver performs key operation to start the engine, or when start operation (for example, brake off) is conducted during idle stop to start the engine.

In Step S202, the start control means 122 determines whether or not the engine rotation speed is smaller than a given value. When the engine rotation speed is smaller than the given value, the processing is advanced to Step S203 in which the normal start control is implemented. On the other hand, when it is determined that the engine rotation speed is equal to or larger than the given value, the processing is advanced to Step S204 in which the start control during the engine rotation is implemented. The engine rotation speed used in this determination may be set to a rotation speed at which the pinion 103 may be engaged with the ring gear 102 when the pinion 103 is pushed, which is, for example, 100 rpm. Upon completion of the processing in Step S203 or Step S204, the processing of the start control device 100 returns to the start.

Figure 3:
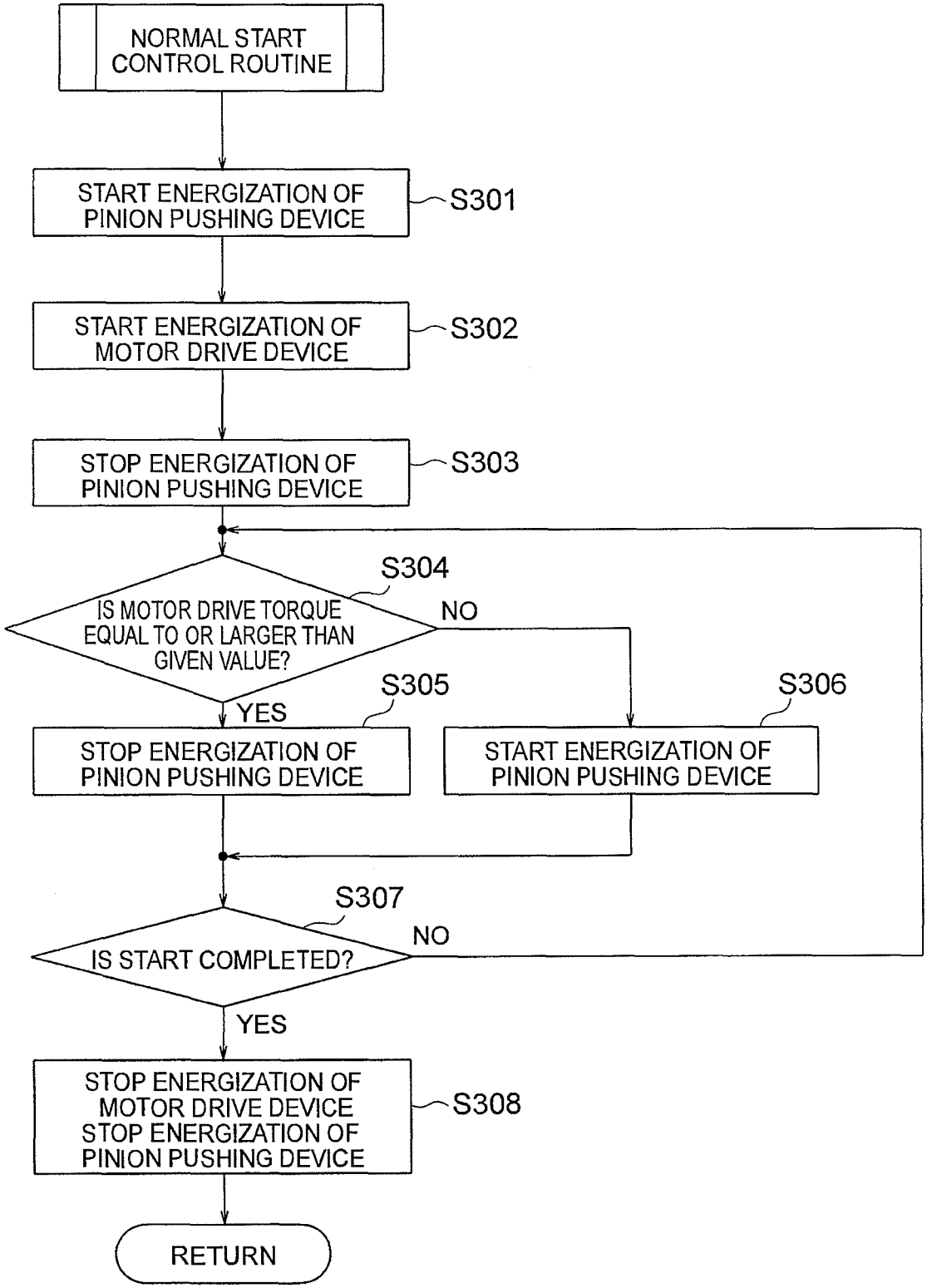
FIG. 3 is a flowchart illustrating details of processing in a normal start operation of FIG. 2.

FIG. 3 is a flowchart illustrating details of the processing in the normal start operation of FIG. 2. Referring to FIG. 3, details of the control in the normal start operation are described. When the normal start control routine starts, the processing is first advanced to Step S301. In Step S301, the energization for the pinion pushing device 104 by the pinion driving means 120 is carried out, and the pinion 103 is pushed into the ring gear 102. Then, in Step S302, the energization for the motor drive device 106 by the motor driving means 121 is carried out, and the motor 105 is rotationally driven. In Step S303, the energization of the pinion pushing device 104 by the pinion driving means 120 is stopped. In the manner as described above, the energization of the pinion pushing device 104 is stopped after the rotational drive of the motor 105 has started, with the result that power consumption in the pinion pushing device 104 is reduced.

In Step S304, the start control means 122 determines whether or not the motor drive torque estimated in the motor drive torque estimating means 123 is equal to or larger than a given value. The given value used for determination of the motor drive torque is described in detail later.

When it is determined in the determination that the motor drive torque is equal to or larger than the given value, the processing is advanced to Step S305. In Step S305, the start control means 122 controls the operation of the pinion driving means 120 to stop the energization of the pinion pushing device 104 by the pinion driving means 120, and stops the operation of pushing the pinion 103 into the ring gear 102. This is because when the motor drive torque is equal to or larger than the given value, the pinion 103 does not come off from the ring gear 102 even if the pushing operation of the pinion 103 is stopped. Thus, the energization of the pinion pushing device 104 is turned off when the motor drive torque is equal to or larger than the given value as described above, to thereby reduce power consumption more reliably while preventing start failure due to the coming off of the pinion 103 from the ring gear 102 from occurring.

On the other hand, when it is determined that the motor drive torque is smaller than the given value, the processing is advanced to Step S306. In Step S306, when the pinion pushing device 104 is energized, the energization of the pinion pushing device 104 is continued. This is because in the case where the motor drive torque is smaller than the given value, there is a possibility that the pinion 103 comes off from the ring gear 102 when the pushing operation of the pinion 103 is stopped.

Further, in the case where it is determined that the motor drive torque is smaller than the given value after the energization of the pinion pushing device 104 by the pinion driving means 120 has stopped, the energization of the pinion pushing device 104 by the pinion driving means 120 is restarted, and the pushing force is again exerted on the pinion 103. Thus, the energization of the pinion pushing device 104 by the pinion driving means 120 is restarted as described above, so that the start failure due to the coming off of the pinion 103 from the ring gear 102 may be prevented from occurring more reliably.

In Step S307, the start control means 122 determines a start completion based on a given start completion condition, such as, for example, a condition that the engine rotation speed is equal to or larger than the given value. The engine rotation speed used for the start completion determination, which is, for example, 700 rpm, may be set to a rotation speed at which the engine may be continuously driven even when the driving operation of the starter 101 is stopped. When it is determined that the start has been completed, the processing is advanced to Step S308, and when the start has not yet been completed, the processing is returned to Step S304.

In Step S308, the operation of the motor driving means 121 is controlled by the start control means 122, to thereby stop the energization of the motor drive device 106 by the motor driving means 121, so that the rotational driving of the motor 105 is stopped. In this situation, the energization of the pinion pushing device 104 by the pinion driving means 120 is also stopped.

Figure 4:
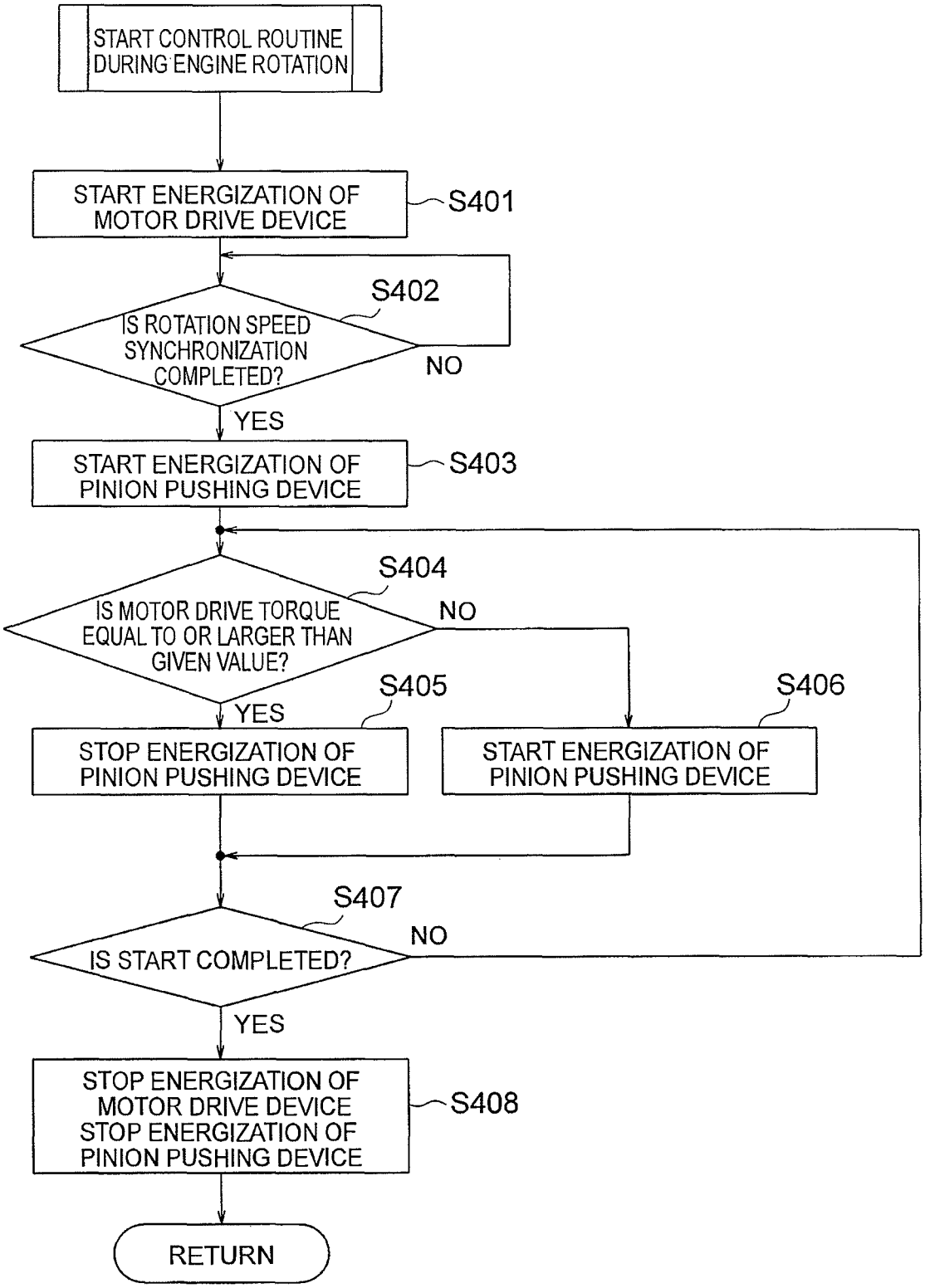
FIG. 4 is a flowchart illustrating details of processing during the rotation of an engine of FIG. 2.

FIG. 4 is a flowchart illustrating details of processing of a start control during the rotation of the engine of FIG. 2. Referring to FIG. 4, details of the start control during the rotation of the engine are described. In FIG. 4, in Step S401, in order to synchronize the rotation speed of the motor 105 with the engine rotation speed, the motor drive device 106 is energized by the motor driving means 121 to rotationally drive the motor 105. In Step S402, it is determined whether or not an absolute value of a difference between the motor rotation speed and the engine rotation speed is equal to or smaller than a given value, and when it is determined that the absolute value of the difference is equal to or smaller than the given value, it is determined that the synchronization has been completed.

The motor rotation speed used in this case may be calculated based on a rotation angle detected by a rotation angle sensor such as a resolver, which is provided to the motor, or may be estimated based on a period of time elapsed since the energization of the motor drive device 106 is started. Further, the given value to be compared with the absolute value of the difference between the motor rotation speed and the engine rotation speed for determination of the synchronization completion, which is, for example, 100 rpm, may be set to a rotation speed at which the pinion 103 may be engaged with the ring gear 102 even if the pinion 103 is pushed into the ring gear 102 during the driving operation of the motor 105.

The determining operation in Step S402 is repetitively implemented until it is determined that the synchronization has been completed. When it is determined that the synchronization has been completed, the processing is advanced to Step S403. In Step S403, the energization for the pinion pushing device 104 by the pinion driving means 120 is carried out so that the pinion 103 is moved to be engaged with the ring gear 102.

In Step S404, it is determined whether or not the motor is driven with the motor drive torque equal to or larger than a given value based on the motor drive torque estimated by the motor drive torque estimating means 123. The given value used for determination of the motor drive torque is described in detail later.

When it is determined in the determination that the motor drive torque is equal to or larger than the given value, the processing is advanced to Step S405. In Step S405, the start control means 122 controls the operation of the pinion driving means 120, to thereby stop the energization of the pinion pushing device 104 by the pinion driving means 120, so that the operation of pushing the pinion 103 into the ring gear 102 is stopped.

On the other hand, when it is determined that the motor drive torque is smaller than the given value, the processing is advanced to Step S406. In Step S406, when the pinion pushing device 104 is energized, the pinion pushing device 104 is continuously energized.

Further, when it is determined that the motor drive torque is smaller than the given value after the energization of the pinion pushing device 104 by the pinion driving means 120 has stopped, the energization of the pinion pushing device 104 by the pinion driving means 120 is restarted, and the pushing force is again exerted on the pinion 103.

In Step S407, the start control means 122 determines the start completion based on a given start completion condition such as a condition that the engine rotation speed is equal to or larger than a given value. When it is determined that the start has been completed, the processing is advanced to Step S408. When the start has not yet been completed, the processing is returned to Step S404. The given value using in the determination may be the same value as the given value used in Step S307 of FIG. 3. In Step S408, the energization of the motor drive device 106 by the motor driving means 121 is stopped, to thereby stop the rotational driving of the motor 105. In this situation, the energization of the pinion pushing device 104 by the pinion driving means 120 is also stopped.

Figure 5:
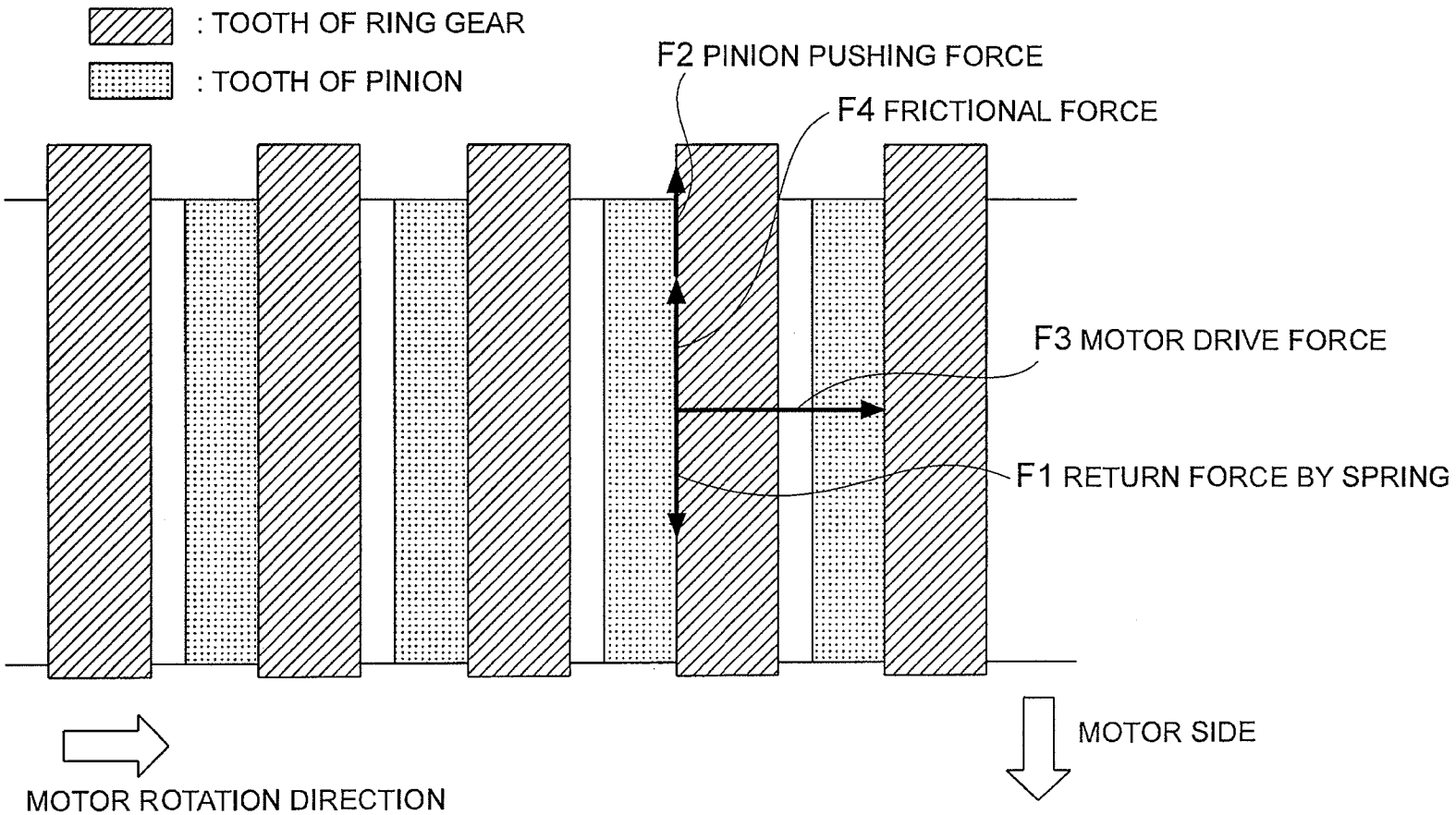
FIG. 5 is an explanatory diagram illustrating a force applied to an engaged portion of a ring gear and a pinion of FIG. 1.

FIG. 5 is an explanatory diagram illustrating a force exerted on an engaged portion of the ring gear 102 and the pinion 103 of FIG. 1. The engaged portion of the ring gear 102 and the pinion 103 is subjected to four forces, namely, a return force F1 produced by a return spring (not shown) disposed to pull out the pinion 103 from the ring gear 102, a pinion pushing force F2 produced by the pinion pushing device 104, a drive force F3 produced by the motor, and a frictional force F4 acting between the ring gear 102 and the pinion 103.

The frictional force F4 acting between the ring gear 102 and the pinion 103 is produced in proportion to the motor drive force F3. For this reason, the frictional force F4 is not produced when the motor is stopped. Accordingly, when the energization of the pinion pushing device 104 is stopped during the stop of the motor driving operation, the pinion 103 comes off from the ring gear 102 by the return force F1 of the return spring.

On the other hand, during the motor driving operation, even when the energization of the pinion pushing device 104 is stopped, the pinion 103 does not come off from the ring gear 102 as long as the frictional force F4 is larger than the return force F1 produced by the return spring. The frictional force F4 acting between the ring gear 102 and the pinion 103 is determined according to a frictional coefficient between the pinion 103 and the ring gear 102, and the drive force of the motor 105. The frictional coefficient between the ring gear 102 and the pinion 103 is determined according to the materials and the surface conditions thereof, which may be grasped in advance. Further, the return force F1 produced by the return spring is determined according to a spring constant which is a known value. That is, the drive force of the motor 105 is grasped so that a condition of "frictional force<return force" may be grasped. As a result, the energization of the pinion pushing device 104 may be restarted when the energization of the pinion pushing device 104 is turned off and "frictional force<return force" is satisfied.

That is, in Step S304 of FIG. 3 and Step S404 of FIG. 4, the given value to be compared with the motor drive torque by the start control means 122 is set to a value of the drive torque of the motor 105, which satisfies the above-mentioned "frictional force F4<return force F1". Thus, the on/off state of the energization of the pinion pushing device 104 by the pinion pushing device 104 is changed over based on the motor drive torque of the motor 105, to thereby prevent the pinion 103 from accidentally coming off while reducing power consumption.

Figure 6:
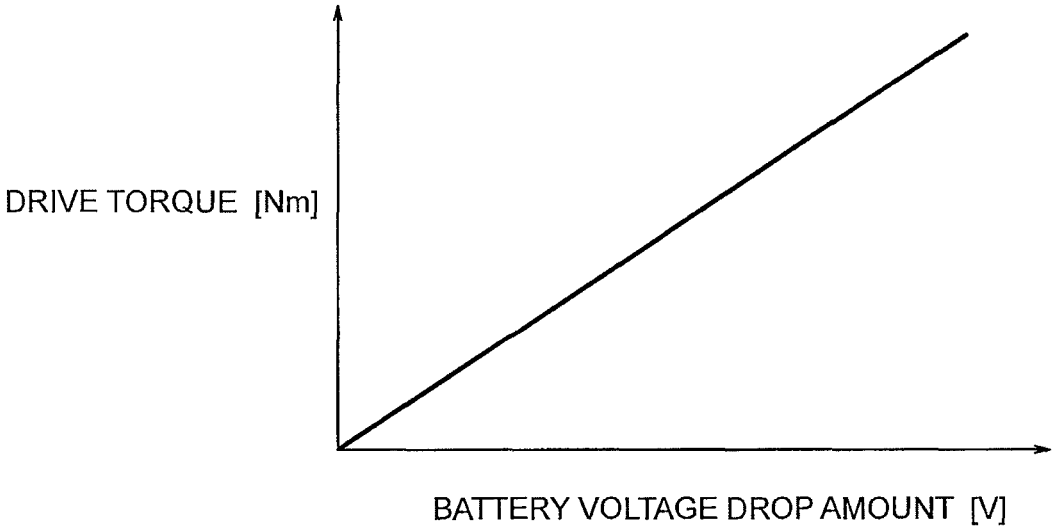
FIG. 6 is a graph illustrating a battery voltage drop amount to a drive torque map used in motor drive torque estimating means of FIG. 1.

FIG. 6 is a graph illustrating a battery voltage drop amount to drive torque map used in the motor drive torque estimating means 123 of FIG. 1. When the motor 105 is driven, the battery voltage drops according to the amount of current flowing in the motor 105. In other words, a value of current flowing in the motor 105 may be estimated from the drop amount of the battery voltage. Further, because the drive torque of the motor 105 is proportional to the value of current flowing therethrough, the drive torque may be estimated if the current value may be estimated. A proportional constant (torque constant) for calculating the torque is a designed parameter, and hence the proportional constant is a known value. For those reasons, as illustrated in FIG. 6, the start torque may be estimated from the battery voltage drop amount. In FIG. 6, a relationship between the battery voltage drop amount and the start torque is a proportional relationship (straight line), but the same effect may be obtained even if the relationship represented by a curved line. Further, in FIG. 6, the start torque is calculated by the aid of the characteristic map. However, the same effect may be obtained even if the drive torque is estimated by the aid of a mathematical expression and a parameter. Thus, the drive torque is estimated from a battery voltage as described above, without newly providing a torque sensor or the like, so that an increase in the costs may be avoided.

In the start control device as described above, the start control means 122 controls the operation of the pinion driving means 120 based on the motor drive torque estimated by the motor drive torque estimating means 123. Therefore, unnecessary energization of the pinion pushing device 104 may be avoided. As a result, power consumption during the driving operation of the stator motor may be reduced, and fuel efficiency of the vehicle may be improved.

Further, the pinion driving means 120 turns on and off the energization of the pinion pushing device 104. The start control means 122 turns off the energization of the pinion pushing device 104 by the pinion driving means 120 when the motor drive torque estimated by the motor drive torque estimating means 123 is equal to or larger than a given value. As a result, power consumption may be more reliably reduced while preventing start failure due to the coming off of the pinion 103 from the ring gear 102 from occurring.

Further, the start control means 122 restarts the energization of the pinion pushing device 104 by the pinion driving means 120 when the motor drive torque becomes smaller than a given value after the energization of the pinion pushing device 104 by the pinion driving means 120 is turned off. Therefore, start failure due to the falling of the pinion 103 out of the ring gear 102 may be more reliably prevented from occurring.

Further, the given value to be compared with the motor drive torque by the start control means 122 corresponds to a value of the drive torque of the motor when the frictional force F4 acting between the ring gear 102 and the pinion 103 is smaller than the return force F1 produced by the return spring disposed for pulling out the pinion 103 from the ring gear 102. Therefore, start failure due to the coming off of the pinion 103 from the ring gear 102 may be more reliably prevented from occurring.

Further, the motor drive torque estimating means 123 estimates the motor drive torque based on the battery voltage drop amount of the battery 107 that supplies an electric power to the motor 105, which eliminate the need to newly provide a torque sensor, so that an increase in cost may be avoided.

Second Embodiment

Figure 7:
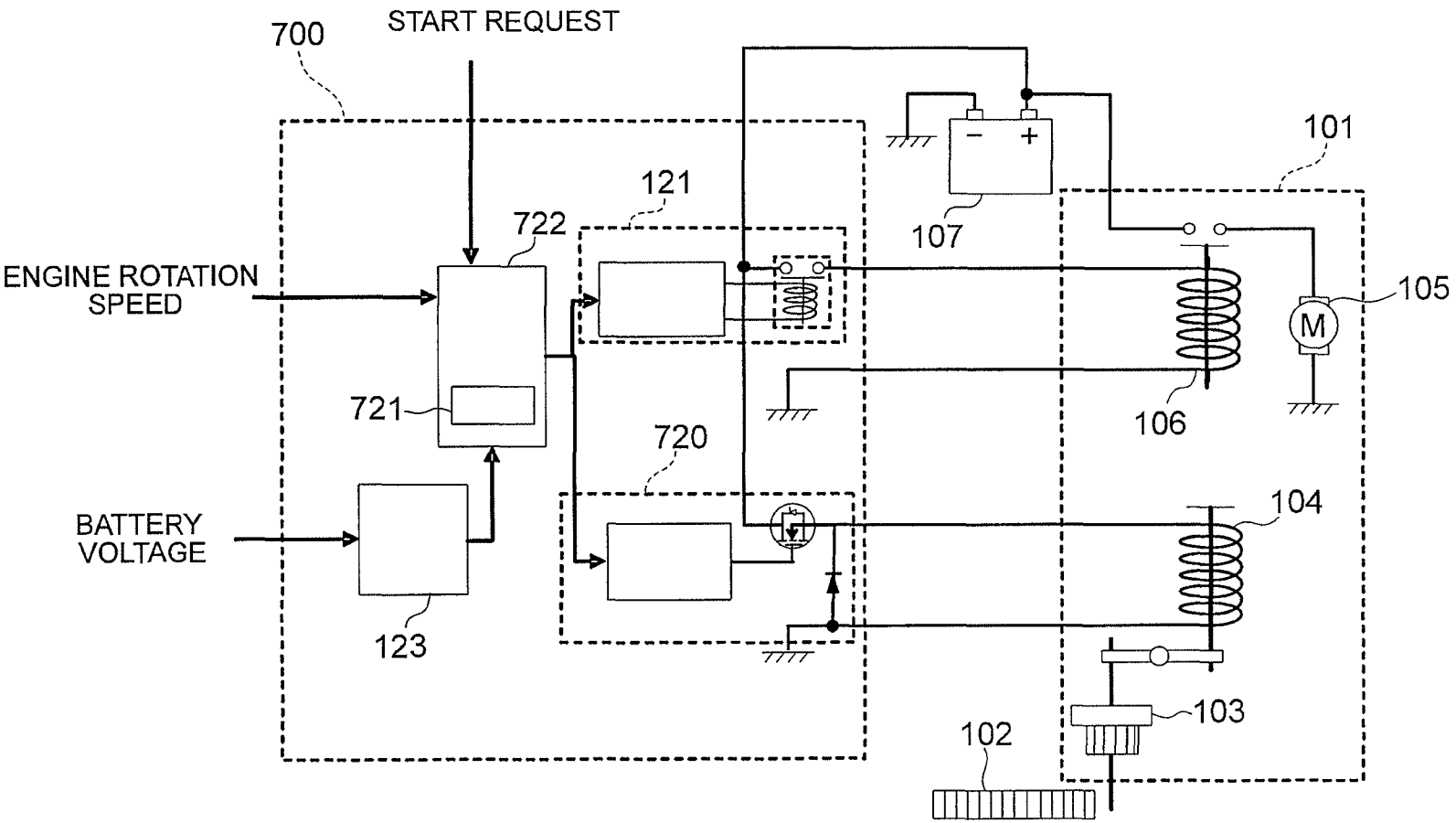
FIG. 7 is a block diagram illustrating a start control device according to a second embodiment of the present invention.

FIG. 7 is a block diagram illustrating a start control device 700 according to a second embodiment of the present invention. A change from the start control device 100 of the first embodiment resides in the pinion driving means 120, and the details of the change are as follows. That is, in the first embodiment, the pinion driving means 120 turns on and off the energization of the pinion pushing device 104 by the relay. However, pinion driving means 720 according to the second embodiment has a switching element such as a metal-oxide-semiconductor field-effect transistor (MOS-FET) instead of the relay, and changes the pinion pushing force F2 (refer to FIG. 5) by changing the duty ratio of the energization of the pinion pushing device 104.

Further, start control means 722 according to the second embodiment includes a duty calculation section 721. The duty calculation section 721 is designed to calculate a duty ratio for obtaining the pinion pushing force required for pushing the pinion 103 toward the ring gear 102, which is described in detail later. The start control means 722 controls the operation of the pinion driving means 720 so that the duty ratio of the energization of the pinion pushing device 104 coincides with the duty ratio obtained by the duty calculation section 721.

The details of the overall processing of the start control device 700 according to the second embodiment are identical with those in the first embodiment, and follow the flowchart illustrated in FIG. 2.

Figure 8:
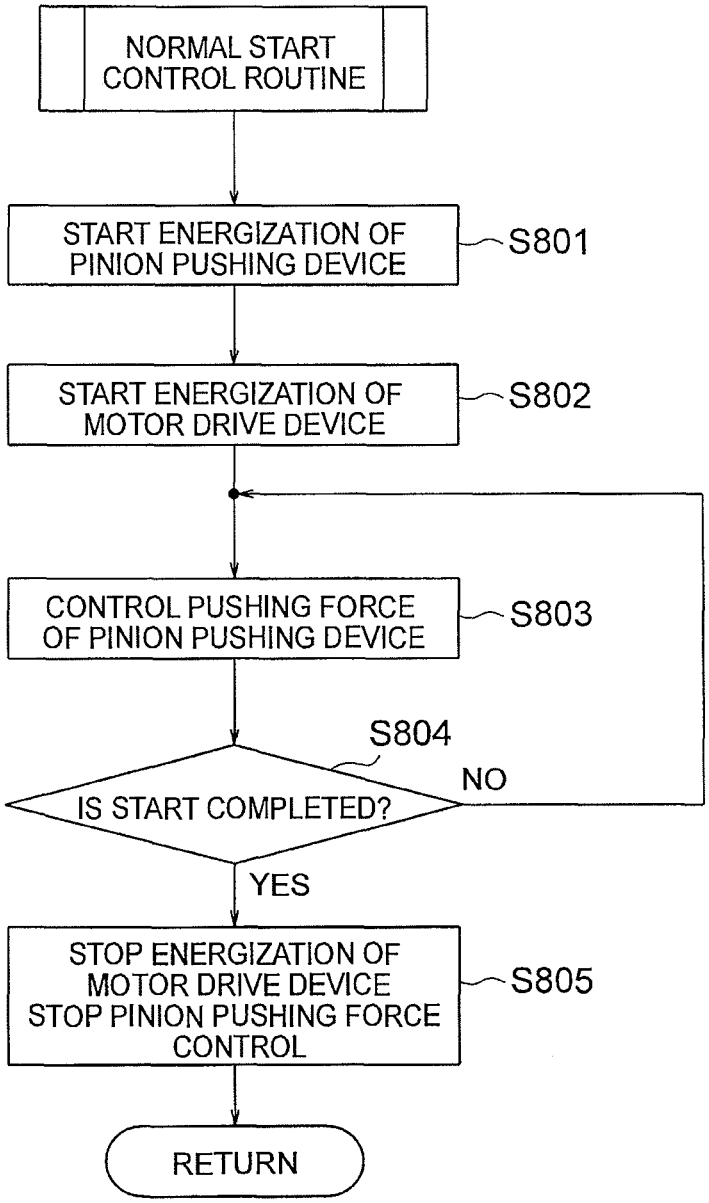
FIG. 8 is a flowchart illustrating details of processing of a normal start control routine implemented by the start control device of FIG. 7.

FIG. 8 is a flowchart illustrating the processing contents of a normal start control routine which are implemented by the start control device of FIG. 7. In the figure, in Step S801, the pinion pushing device is energized by the pinion driving means 720 in a state where the drive duty ratio is 100%, and the pinion 103 is engaged with the ring gear 102. In Step S802, the motor drive device 106 is energized by the motor driving means 121 so that the motor 105 is rotationally driven.

In Step S803, the duty ratio for obtaining the pinion pushing force required for pushing the pinion 103 toward the ring gear 102 is calculated by the duty calculation section 721 based on the motor torque estimated by the motor drive torque estimating means 123. Then, the operation of the pinion driving means 720 is controlled by the start control means 722 so that the duty ratio of the energization of the pinion pushing device 104 coincides with the duty ratio obtained by the duty calculation section 721. In other words, in the pinion driving means 720, the switching element is driven at the duty ratio calculated by the duty calculation section 721.

The operation of the pinion driving means 720 is thus controlled by the start control means 722 so that the duty ratio of the energization of the pinion pushing device 104 coincides with the duty ratio obtained by the duty calculation section 721. As a result, the energization of the pinion pushing device 104 may be suppressed to a degree that a minimal frictional force F4 is obtained, with the result that power consumption by the pinion pushing device 104 may be suppressed.

In Step S804, it is determined whether or not start has been completed, based on a given start completion condition such as a condition that the engine rotation speed is equal to or larger than a given value. The given value used for the start completion determination may be the same value as the given value used in Step S307 of FIG. 3. When it is determined that the start has been completed, the processing is advanced to Step S805. When it is determined that the start has not yet been completed, the processing is returned to Step S803. In Step S805, the energization of the motor drive device 106 by the motor driving means 121 is stopped, so that the motor is stopped. At this time, the pinion pushing force control is also stopped.

Figure 9:
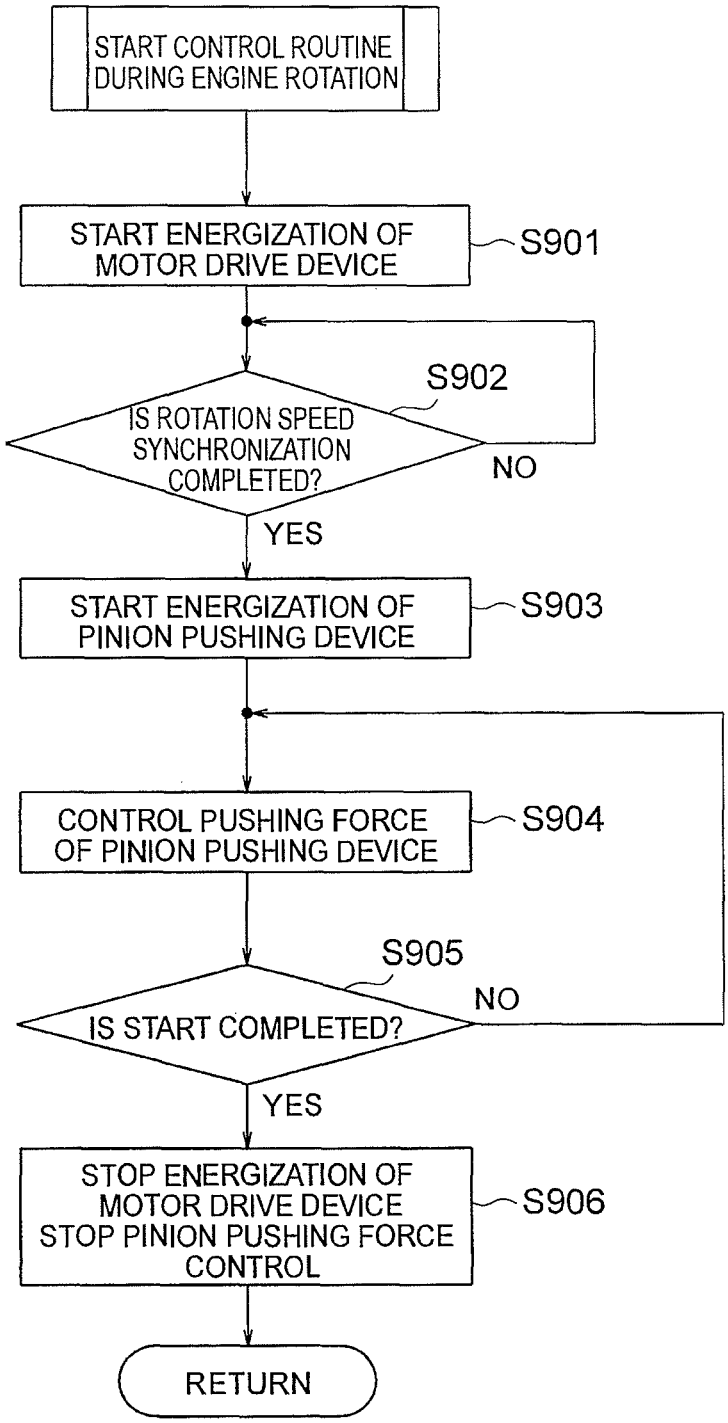
FIG. 9 is a flowchart illustrating a start control routine during the rotation of the engine, which is implemented by the start control device of FIG. 7.

FIG. 9 is a flowchart illustrating a start control routine during the rotation of the engine, which is implemented by the start control device of FIG. 7. In FIG. 9, in Step S901, in order to synchronize the rotation speed of the motor 105 with the engine rotation speed, the motor drive device 106 is energized by the motor driving means 121 to rotationally drive the motor 105. In Step S902, it is determined whether or not an absolute value of a difference between the motor rotation speed and the engine rotation speed is equal to or smaller than a given value, and when it is determined that the absolute value of the difference is equal to or smaller than the given value, it is determined that synchronization has been completed.

The motor rotation speed used in this example may be measured by a rotation speed sensor such as a resolver, which is provided to the motor, or may be estimated based on a period of time elapsed since the energization of the motor drive device 106 is started. Further, the given value to be compared with the absolute value of the difference between the motor rotation speed and the engine rotation speed for determination of the synchronization completion may be the same value as the given value used in Step S402 of FIG. 4.

The determining operation in Step S902 is repetitively implemented until it is determined that the synchronization has been completed. When it is determined that the synchronization has been completed, the processing is advanced to Step S903. In Step S903, in the pinion driving means 720, the pinion pushing device is energized by the pinion driving means 720 in a state where the drive duty ratio is 100%, and the pinion 103 is engaged with the ring gear 102.

In Step S904, the duty ratio for obtaining the pinion pushing force required for pushing the pinion 103 toward the ring gear 102 is calculated by the duty calculation section 721 based on the motor torque estimated by the motor drive torque estimating means 123. Then, the operation of the pinion driving means 720 is controlled by the start control means 722 so that the duty ratio of the energization of the pinion pushing device 104 coincides with the duty ratio obtained by the duty calculation section 721. In other words, in the pinion driving means 720, the switching element is driven at the duty ratio calculated by the duty calculation section 721.

In Step S905, it is determined whether or not start has been completed, based on a given start completion condition such as a condition that the engine rotation speed is equal to or larger than a given value. In this case, when it is determined that the start has been completed, the processing is advanced to Step S906. When it is determined that the start has not yet been completed, the processing is returned to Step S904. The given value used for the start completion determination may be the same value as the given value used in Step S307 of FIG. 3. In Step S906, the energization of the motor drive device 106 by the motor driving means 121 is stopped, so that the motor is stopped. In this case, the pinion pushing force control is also stopped.

Figure 10:
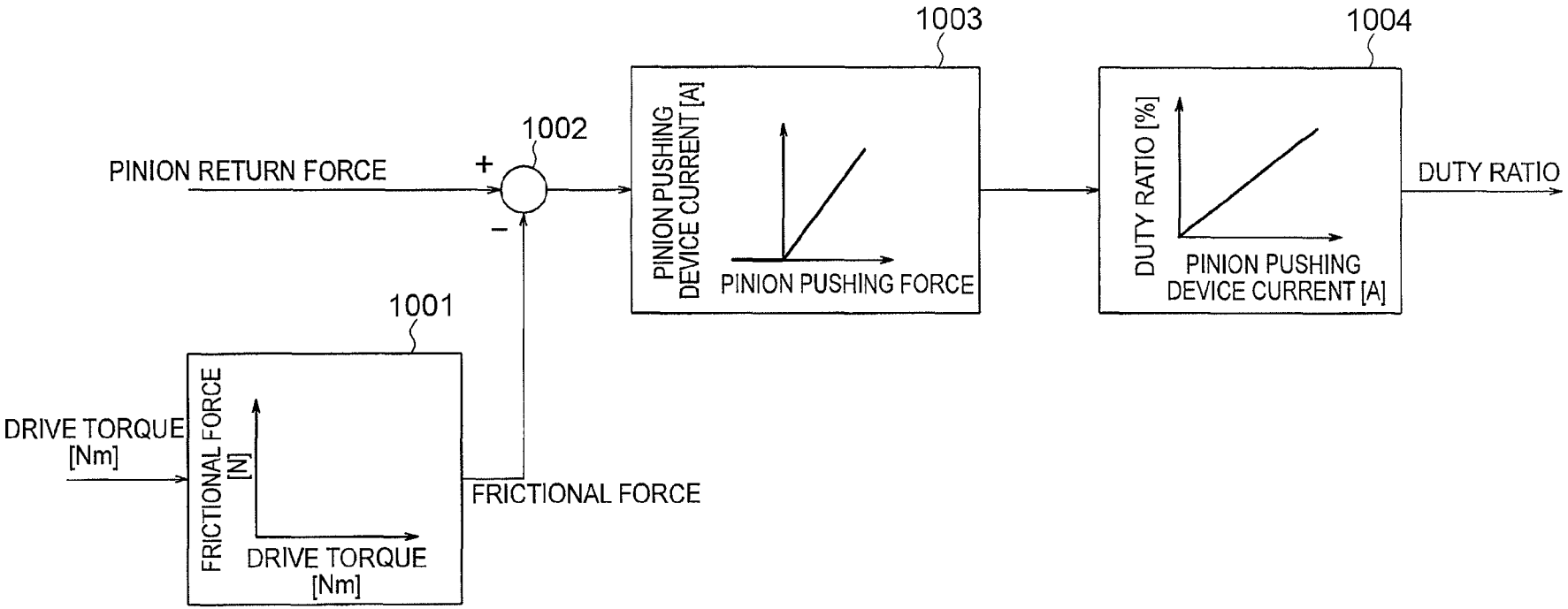
FIG. 10 is a block diagram illustrating details of processing of a duty calculation section of FIG. 7.

Next, FIG. 10 is a block diagram illustrating details of the processing in the duty calculation section 721 of FIG. 7. In FIG. 10, the duty calculation section 721 calculates the frictional force F4 (refer to FIG. 5) produced between the ring gear 102 and the pinion 103, based on the drive torque estimated by the motor drive torque estimating means 123 and a map 1001. Because the frictional force F4 is determined according to the frictional coefficient and the normal force (drive torque), the frictional force may be calculated according to the map 1001. In this embodiment, the map is used for calculation of the frictional force F4, but other estimating means may be applied.

Then, the duty calculation section 721 subtracts the frictional force F4 from the pinion return force F1 shown as 1002, to thereby calculate the pinion pushing force F2 required for pushing the pinion 103 toward the ring gear 102. Because the pinion return force F1 is produced by the spring, when the characteristics of the spring are grasped in advance, the pinion return force F1 may be estimated.

Then, the duty calculation section 721 calculates a value of a current to be supplied to the pinion pushing device 104, based on the calculated pinion pushing force F2 and a map 1003. Here, when the relation that frictional force≥the pinion return force is satisfied, the pinion pushing force F2 is obtained as a negative value, and even if the pinion pushing device 104 is not energized, the pinion 103 does not come off from the ring gear 102. Further, because the pinion pushing device 104 is formed of a coil, a value of a current to be supplied to the pinion pushing device 104 may be obtained from the pinion pushing force F2.

Then, the duty calculation section 721 obtains the duty ratio of the energization of the pinion pushing device 104 for attaining the required pinion pushing force F2, based on a value of a current to be supplied to the pinion pushing device 104, and a map 1004. In the map 1004, the value of a current to be supplied to the pinion pushing device 104 and the duty ratio have a linear relationship, but this relationship may not be linear. Further, the map 1004 may be corrected by the aid of a battery voltage.

In the start control device as described above, the start control means 722 controls the operation of the pinion driving means 720 so that the duty ratio of the energization of the pinion pushing device 104 coincides with the duty ratio obtained by the duty calculation section 721. Therefore, the energization of the pinion pushing device 104 may be suppressed to a degree that a minimal frictional force F4 is obtained, and power consumption in the pinion pushing device 104 may be suppressed.

What is claimed is:

1. A start control device, comprising:

pinion driving means for driving a pinion pushing device that pushes a pinion into a ring gear coupled with an engine;

motor driving means for driving a motor drive device that rotationally drives a motor coupled with the pinion;

start control means for controlling an operation of the pinion driving means and the motor driving means to start the engine, in response to a start request externally received; and motor drive torque estimating means for estimating a motor drive torque of the motor, wherein the start control means controls the operation of the pinion driving means, based on the motor drive torque estimated by the motor drive torque estimating means.

2. A start control device according to any one of claim 1, wherein the motor drive torque estimating means estimates the motor drive torque, based on a battery voltage drop amount of the battery that supplies an electric power to the motor.

3. A start control device according to claim 1, wherein the pinion driving means changes a duty ratio of the energization of the pinion pushing device, to thereby change the pinion pushing force, and wherein the start control means includes a duty calculation section that calculates a duty ratio for obtaining a pinion pushing force required for pushing the pinion toward the ring gear, based on the motor drive torque estimated by the motor drive torque estimating means and the return force produced by the return spring disposed for pulling out the pinion from the ring gear, and controls the operation of the pinion driving means so that the duty ratio of the energization of the pinion pushing device coincides with the duty ratio obtained by the duty calculation section.

4. A start control device according to claim 1, wherein the pinion driving means turns on and off energization of the pinion pushing device, and wherein the start control means turns off the energization of the pinion pushing device by the pinion driving means when the motor drive torque estimated by the motor drive torque estimating means is equal to or larger than a given value.

5. A start control device according to claim 4, wherein the start control means restarts the energization of the pinion pushing device by the pinion driving means when the motor drive torque becomes smaller than the given value after the energization of the pinion pushing device by the pinion driving means is turned off.

6. A start control device according to claim 4, wherein the given value which is compared with the motor drive torque by the start control means is a value of a drive torque of the motor when a frictional force acting between the ring gear and the pinion is smaller than a return force produced by a return spring disposed for pulling out the pinion from the ring gear.

* * * * *